US005630585A

United States Patent [19]

Takemoto et al.

[11] Patent Number: 5,630,585

[45] Date of Patent: May 20, 1997

[54] PACHINKO BALL COUNTER AND BALL DROPPING APPARATUS PREVENTING BRIDGE PHENOMENON

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 338,546

[22] PCT Filed: Jun. 2, 1993

[86] PCT No.: PCT/JP93/00742

§ 371 Date: Feb. 24, 1995

§ 102(e) Date: Feb. 24, 1995

[87] PCT Pub. No.: WO93/25289

PCT Pub. Date: Dec. 23, 1993

[30] Foreign Application Priority Data

| | | | |
|---|---|---|---|
| Jun. 11, 1992 | [JP] | Japan | 4-152416 |
| Sep. 7, 1992 | [JP] | Japan | 4-238659 |

[51] Int. Cl.[6] ..... A63F 7/02

[52] U.S. Cl. ..... 273/121 B

[58] Field of Search ..... 273/118, 119, 273/121

[56] References Cited

FOREIGN PATENT DOCUMENTS

| | | | |
|---|---|---|---|
| 52-46203 | 10/1977 | Japan . | |
| 53-40351 | 10/1978 | Japan . | |
| 60-31782 | 2/1985 | Japan . | |
| 61-8088 | 1/1986 | Japan . | |
| 62-45074 | 3/1987 | Japan . | |
| 2-68887 | 5/1990 | Japan . | |
| 2-156975 | 6/1990 | Japan . | |
| 2-116490 | 9/1990 | Japan . | |
| 3-18388 | 1/1991 | Japan . | |
| 4-197374 | 7/1992 | Japan . | |
| 40/5208064 | 8/1993 | Japan | 273/121 B |
| 40/6031039 | 2/1994 | Japan | 273/121 B |
| 40/6047132 | 2/1994 | Japan | 273/121 B |
| 40/6142311 | 5/1994 | Japan | 273/121 B |
| 94/01187 | 1/1994 | WIPO | 273/121 B |
| 94/09875 | 5/1994 | WIPO | 273/121 B |

*Primary Examiner*—Raleigh W. Chiu

*Attorney, Agent, or Firm*—Armstrong, Westerman, Hattori, McLeland & Naughton

[57] ABSTRACT

A pachinko ball counter which aligns discharged pachinko balls in a plurality of lines by a plurality of alignment rails, and sends them reliably to a plurality of counting sensors without generating a so-called "bridging phenomenon" and which can smoothly and quickly count a large number of pachinko balls, and a pachinko ball dropping apparatus which can drop smoothly and gently a large number of pachinko balls discharged at a high speed from the ball counter to send them to a recovery gutter without a bridging phenomenon and which can adjust the length of a member in conformity with the height of the recovery gutter easily, quickly and without waste. An introduction path (17) for sending pachinko balls charged by a player is disposed at the back of a ball tray (C) of a game machine (B), and a plurality of alignment rails (18, 18, 18, 18), through which pachinko balls flow in an aligned state, are juxtaposed with one another in this introduction path (17). Partition guides (16) are disposed between the alignment rails (18), and counting sensors (40, 41) are so disposed at the end side of the introduction path (17) as to correspond to the alignment rails, respectively. Pachinko balls accommodated in a hopper member (111) fall through a ball path (119) encompassed by both side frame portions (117, 117) of a guide member (115) and by its back frame portion (116). During the fall, a falling force is damped by a plurality of damper members (120) fitted in the inside of both side frame portions (117, 117), and the balls are sent to a recovery gutter (150). A plurality of notches (118) are disposed in a vertical direction for cutting off the guide member (115) at an arbitrary length so as to regulate the lower end position of the guide member (115) to the height of the recovery gutter (150).

8 Claims, 6 Drawing Sheets

PACHINKO BALL COUNTER AND BALL DROPPING APPARATUS PREVENTING BRIDGE PHENOMENON

TECHNICAL FIELD

This invention relates to a pachinko ball counter mounted to a game machine (especially a slot machine using a pachinko ball as a game medium) which is placed in a pachinko parlor. The game machine is equipped with an introduction path for aligning pachinko balls charged in a ball tray of the machine; and the pachinko ball counter counts pachinko balls, aligned in the introduction path, by counting sensors which are disposed aligned at the end of the introduction path. Furthermore, the present invention relates to a ball dropping apparatus for inducing and dropping pachinko balls, discharged after counting by the pachinko ball counter, into a recovery gutter located in the lower portion of a game island.

BACKGROUND ART

As a prior pachinko ball counter for counting pachinko balls charged into a game machine by a player, the following is known to persons skilled in the art. A game machine, equipped with a pachinko ball counter, having an alignment rail in an introduction path for sending pachinko balls charged from a ball-inserting port of the game machine into the inside; the pachinko ball counter counting pachinko balls, aligned in a line by the alignment rail, by sensors which consist of photoelectric switches positioned in the end side of said introducing path.

If the pachinko balls, discharged after counting by the pachinko ball counter, drop directly into a recovery gutter located in the lower portion ot a game Island, loud noises are generated and the recovery gutter can be made to have holes. Therefore, in the prior art, a pachinko ball counter has been connected to a recovery gutter via a long pitch spring member (called a "reduction bellows") so as to drop quietly.

Furthermore, some prior art is equipped with a cylindrical member which reaches lower recovery gutter at a ball dispensing port of the ball counter, and a plurality of damper members for damping a falling force of the pachinko ball are mounted alternately on the inside of the cylindrical member.

Some game machines, especially a slot machine which uses a pachinko ball in place of a coin as a game medium, need a large number of pachinko balls in comparison with the number of coins used in a slot machine (generally five pachinko balls correspond to one coin). Since such a game machine must count the pachinko balls one by one with only one counting sensor mounted on a single alignment rail, trouble occurs in that the time for counting becomes long, and so game playing is hindered by the counting time.

In a slot machine using pachinko balls, since a large number of pachinko balls are discharged to the alignment rail intermittently, the alignment rail is shortened and made steep so as to dispense the pachinko balls in a short time; therefore, the so-called "bridging phenomenon" can occur, wherein during flowing the upper balls pile up on other lower pachinko balls and are caught so they, together with lower pachinko balls, stop at the end side of the alignment rail. Therefore, ball counting will have stagnated and so the trouble of interruption of playing will occur.

In the prior art that uses said spring member for flowing pachinko balls discharged from the pachinko ball counter, although it is effective when one pachinko balls are discharged in a line from the ball counter, the bridging phenomenon will occur at an inlet of the spring member when a number of the balls are discharged fast from the ball counter; therefore, pachinko balls will not be able to flow into the recovery gutter smoothly and the game will often be interrupted.

In the case that the counter is equipped with the cylindrical member, although the bridging phenomenon does not occur and lots of the pachinko balls can be counted and discharged fast, the cylindrical member must be cut appropriately by a cutter, etc., when the cylindrical member is mounted to the pachinko ball counter for leaving a proper space between the lower end of the cylindrical member and a recovery gutter located in the lower area of a game machine island. Therefore, a great deal of time and labor is required for mounting the cylindrical member, and much of the cylindrical member is wasted because the cutting off length is not constant and so many odd pieces are made.

DISCLOSURE OR THE INVENTION

It is an object or the invention to provide a pachinko ball counter which enables one to count many pachinko balls in a short time smoothly by both aligning charged pachinko balls in a plurality of lines with a plurality of alignment rails and sending them to a plurality of counting sensors without generating the so-called "bridging phenomenon".

It is another object of the invention to provide a pachinko ball dropping apparatus which enables one to drop smoothly and gently a large number of pachinko balls discharged at a high speed from the ball counter to send them to a recovery gutter without a bridging phenomenon and to adjust the length of a member in conformity with the height of the recovery gutter easily, quickly and without waste.

Points of the present invention for accomplishing the foregoing and other objects are as follows.

A pachinko ball counter (10) having an introduction path (17) for sending pachinko balls (A), discharged into a tray (C) by a player, with aligning them and counting said pachinko balls with counting sensors (40, 41) mounted to the end side of said introduction path (17) comprising:

- a plurality of alignment rails (18), through which pachinko balls (A) flow in an aligned state, juxtaposed with one another between a beginning end and a terminal end of the introduction path (17); and
- partition guides (16) disposed between the alignment rails (18), said counting sensors (40, 41) are so disposed at the end side of the introduction path (17) as to correspond to the alignment rails, respectively.

The above-mentioned pachinko ball counter (10) further comprising an intake stage (14), connected to a beginning end of said introduction path (17), for taking in pachinko balls, and a shutter (20), mounted between said intake stage (14) and said beginning end of said introduction path (17), being able to be opened and closed.

The above-mentioned pachinko ball counter (10) characterized in that a plurality of said alignment rails (18) are aligned parallel to one another and inclined downwardly from the beginning end to the terminal end for pachinko balls' natural flowing and that an upper edge (16*a*) of each partition guide (16) which is mounted between the alignment rails (18, 18, . . . ) is so sloped upward from the beginning side to the end side so that the pachinko balls may not get over the partition guide (16).

The above-mentioned pachinko ball counter, further comprising a moving body (30) mounted above the beginning end of each alignment rail (18) for pachinko balls without the lowest layer's to hit against it and to stop their forward flowing.

The above-mentioned pachinko ball counter further comprising a cylindrical ball dropping apparatus (50) mounted in the end side of said introduction path (17) for introducing discharged pachinko balls downward and damper members (120) mounted on the inside of said ball dropping apparatus for absorbing the energy of dropping balls.

A pachinko ball dropping apparatus (50) of a game machine (B) mounted on a game island for introducing and dropping pachinko balls, counted and discharged with a pachinko ball counter (10), into a recovery gutter (150) located in the lower portion of the game island comprising:

a hopper member (111) opened and faced to an exit (**19*b***) for accommodating pachinko balls;

a guide member (115), connected to a sending-out opening (114) made in a bottom (113) of said hopper member (111), which comprises a back frame portion (116) elongated in the vertical direction and both side frame portions (117, 117) elongated forward from both side edges of the back frame portion (116); and a damper members (120) mounted alternately on the inside of the both side frame portions (117, 117) for absorbing the energy of dropping balls dropping within a ball path (119) encompassed by both side frame portions (117, 117) and back frame portion (116), said both side frame portions (117, 117) are cut a plurality of notches (118) in vertical direction for adjusting the position of the lower end of said guide member (115) to the height of the recovery gutter (150) by cutting off the guide member (115) at an arbitrary notch.

Thus, when the pachinko balls (A), discharged into the ball tray (C) of the game machine (B) by a player, have entered the introduction path (17), they are distributed on alignment rails (18, 18, . . . ), located parallel one another between the beginning end and the terminal end of the introduction path (17), with each partition guide (16), and pachinko balls (A) on each alignment rail (18) are sent to the end side of the introduction path (17) in an aligned state.

Therefore, lots of pachinko balls (A), in a plurality of lines, are sent to counting sensors (40, 41) placed to each alignment rail (18) and a plurality of pachinko balls (A) can be counted smoothly and quickly at once. In the case that an intake stage (14) for taking pachinko balls is mounted before the beginning end of said introduction path (17) and a shutter (20) enabled to open and close is mounted between said intake stage (14) and said beginning end of said introduction path (17), the amount of pachinko balls introducing into said introduction path (17) can be adjusted arbitrarily by said shutter (20).

If an upper edge (**16*a*) of each partition guide (16) which is mounted between the alignment rails (18, 18, . . . ) is so sloped upward from the beginning side to the end side that the pachinko balls may not get over the partition guide (16), the bridging phenomenon near the counting sensors (40, 41**) is prevented from being generated.

If a moving body (30) is mounted above the beginning end of each alignment rail (18), pachinko balls (A), without the lowest layer's pachinko balls, hit against the moving body (30) and are stopped from their forward flowing. At that time, since the upper layer's pachinko balls (A) can move slightly because of the motion of the moving body, the lowest layer's pachinko balls (A) are not prevented from their forward flowing; and a plurality of pachinko balls (A) in a plurality of lines are counted smoothly with counting sensors (40, 41).

If a cylindrical pachinko ball dropping apparatus (50) for introducing discharged pachinko balls (A) downward are connected to the end side of the introduction path (17), the energy of dropping balls can be absorbed.

Thus, in the game machine (B), pachinko balls, counted by pachinko ball counter (10), are discharged first into the hopper (111) faced the exit (**19*b*) of the ball counter (10). The pachinko balls in the hopper (111) are sent from the sending-out opening (114) to the guide member (115) connected between said sending-out opening (114) and a recovery gutter (150**) located in the lower portion of the game island.

The pachinko balls drop within the ball path (119) encompassed by both side frame portions (117, 117) and the back frame portion (116) of the guide member (115), and at that time the energy of dropping balls is absorbed by the damper members (120) mounted alternately on the inside of both side frame portions (117, 117). Therefore, the pachinko balls are introduced smoothly and gently into the recovery gutter (150).

The sectional area of the ball path (119) is made large by making widths of both side frame portions (117, 117) of the guide member (115) to be about a size such that a plurality of pachinko balls can pass concurrently; therefore, lots of pachinko balls can drop smoothly and gently.

Since there is nothing in the front side of the ball path (119), encompassed by both side frame portions (117, 117) and the back frame portion (116), it is visible that the pachinko balls drop within the ball path (119) with hitting against the damper members (120) to the recovery gutter (150). Furthermore, it is easy to remove and eliminate the jammed balls and the dust in the ball path (119).

Since a plurality of notches (118) for arbitrary cutting off the guide member (115) are made on both side frame portions (117, 117), it is easy to cut off one guide member (115) at an arbitrary notch (118); thereby, waste odd pieces of the guide member (115) are not made, and it is easy to adjust quickly the position of the lower end of the guide member (115) to the height of the recovery gutter (150).

The guide member (115) that has been made somewhat longer can easily be adjusted to the height of the recovery gutter (150) by cutting it off at the proper notch; further, the remaining portion of the guide member (115) can be utilized for other pachinko ball dropping apparatuses.

If guide members (115) are made of materials such as rubber or soft synthetic resin, the workability of the guide member when the guide member (115) is mounted to the hopper member (111) or is cut off becomes better; and also the crashing sound generated by the impact of the balls becomes smaller. It becomes easier to cut off the guide member (115) by making notches such as V-shape grooves (280) on the back frame portion (116) of the guide member (115) at the same height of the notches (118) made on both side frame portions (117, 117). According to the material of the guide member (115), the guide member (115) can be wrested by one's hands along the notch (118).

BEST MODES FOR CARRYING OUT THE INVENTION

Referring now to the accompanying drawings, there are shown preferred embodiments of the invention.

Figure 1:
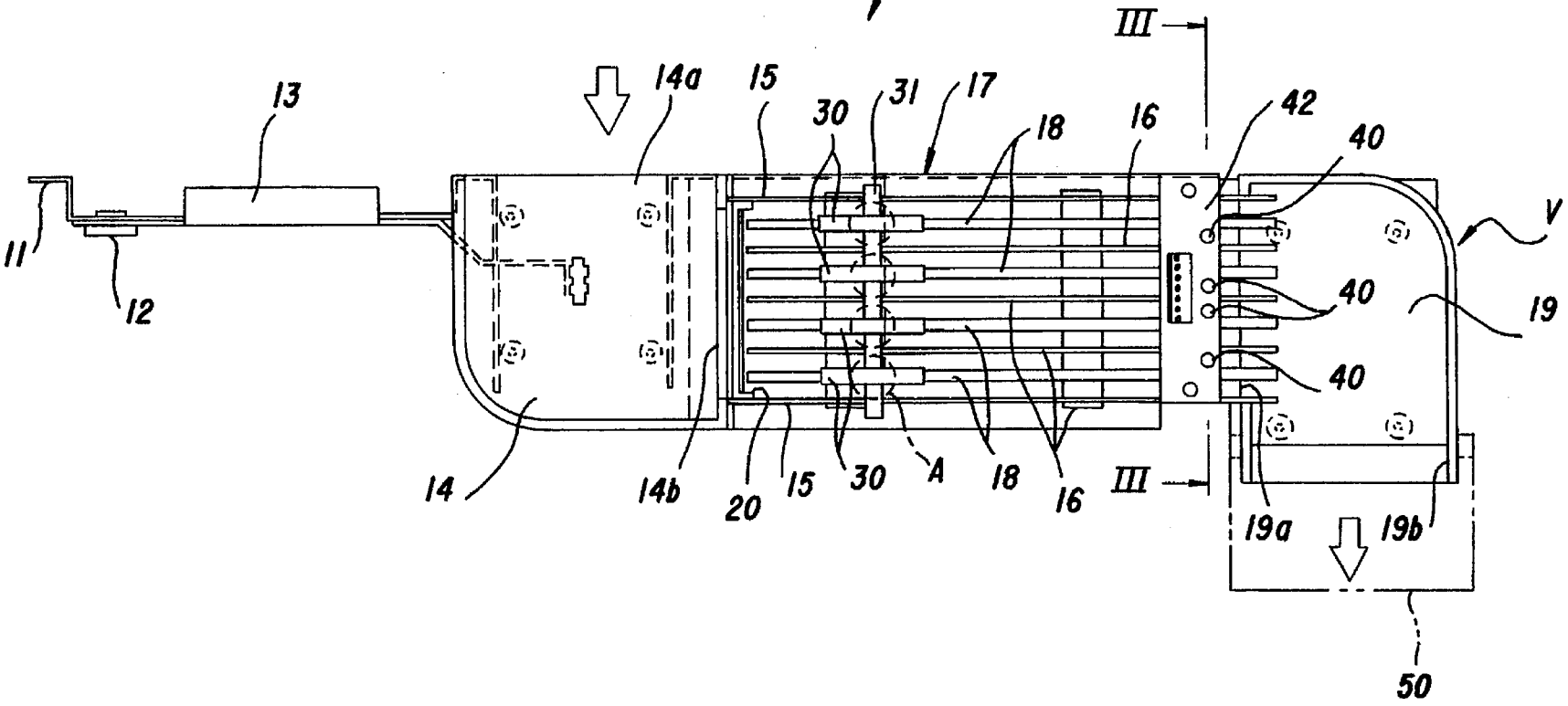
FIG. 1 is a plan view showing a pachinko ball counter according to one embodiment of the invention.
Figure 2:
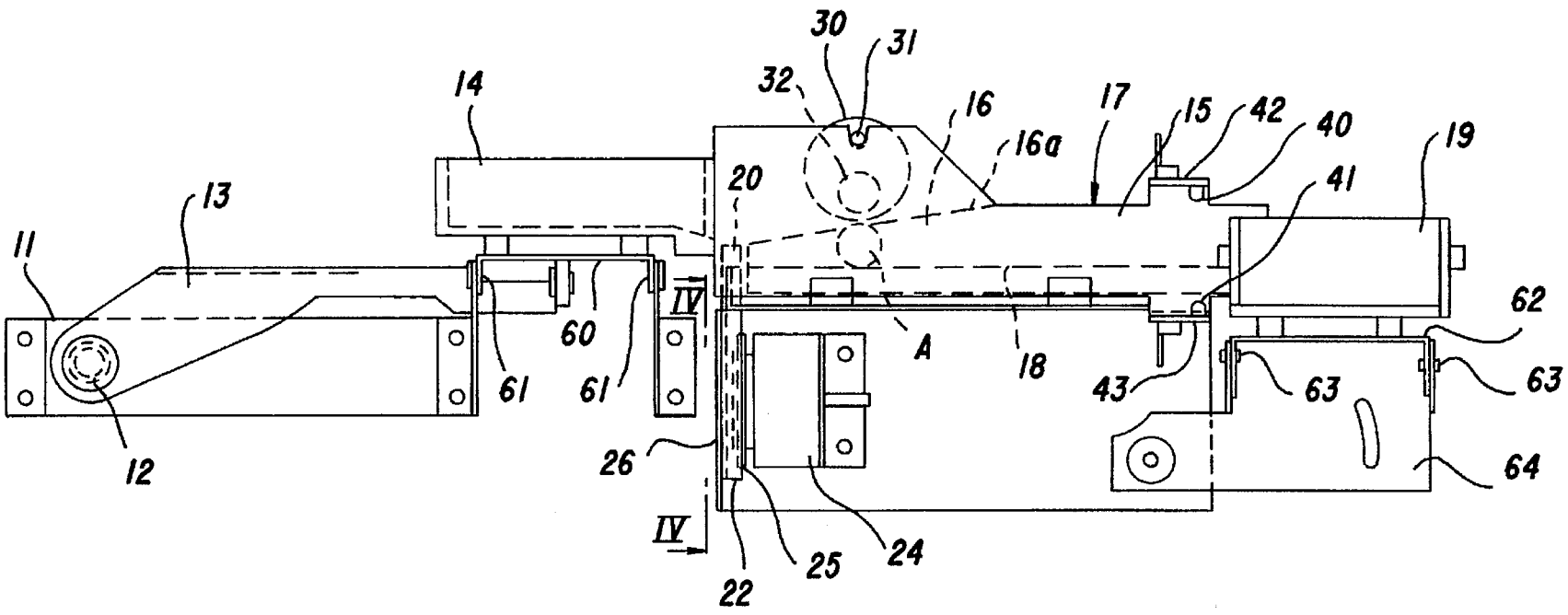
FIG. 2 is a front view showing one embodiment of a pachinko ball counter of the invention.
Figure 8:
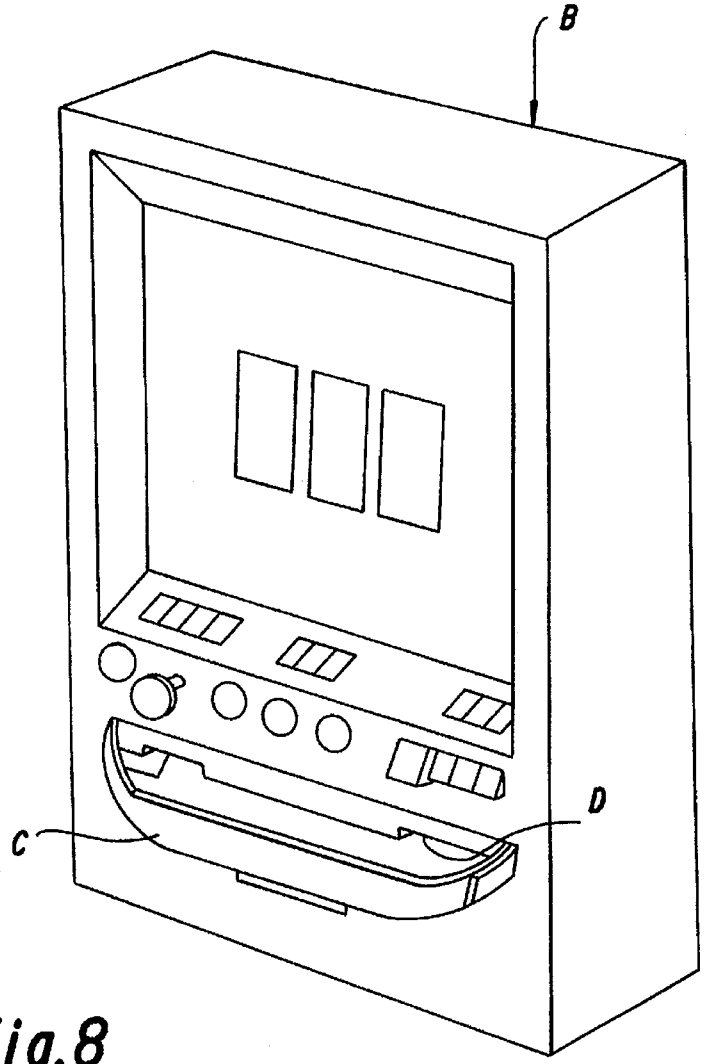
FIG. 8 is a perspective view showing a slot machine, using a pachinko ball as a game medium, which is equipped with one embodiment of a pachinko ball counter of the invention.

A slot machine B using a pachinko ball as a game medium (hereinafter referred to as Pachisulo) is shown in FIG. 8. As shown in FIG. 1 and FIG. 2, a pachinko ball counter 10 counts a pachinko ball A, discharged from the ball inserting port D of the ball tray C of the Pachisulo B into its inside by a player, by counting sensors 40, 41.

The pachinko ball counter 10 comprises an intake stage 14 for taking in the pachinko ball A input to the ball inserting port D of the ball tray C in the Pachisulo B, an introduction path 17 whose beginning end is connected to the intake stage 14, four alignment rails 18, 18 . . . mounted parallel to one another within the introduction path 17, counting sensors 40, 41 disposed at the end sides of the alignment rails, and a delivery stage 19 connected to the finishing end side of the introduction path 17.

The intake stage 14 has a stage capacity of the given number of the pachinko balls. The inlet 14*a* of the intake stage 14 is connected to a ball inserting port D, and the outlet 14*b* of the intake stage 14 is in perpendicular direction and connected to the beginning end at the introduction path 17. As shown in FIG. 2, the intake stage 14 is fixed to a stage support 60 and the stage support 60 is movably mounted to a support bracket 11 by pivots 61, 61.

The intake stage 14 is slanted from the inlet 14*a* to the outlet 14*b*, and the slant is able to be adjusted by an arm member 13. One end of the arm member 13 is linked with, pivotably on a pivot 12, the support bracket 11, the other end is fixed to the backside of the bottom of the stage support 60.

Figure 4:
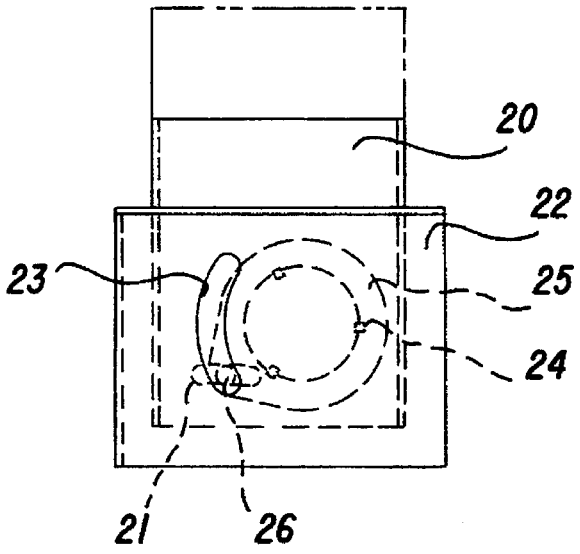
FIG. 4 is a cross sectional view taken along line IV—IV of FIG. 2.

As shown in FIG. 1, FIG. 2 and FIG. 4, a shutter 20 which is able to open and shut is mounted between the outlet 14*b* of the intake stage 14 and the beginning end of the introduction path 17. The shutter 20 is able to be moved optionally in its position between the opened state (shown in FIG. 4 with full lines) and the closed state (shown in FIG. 4 with phantom lines) by a rotary solenoid 24 as a drive means. When in the closed state, the pachinko balls in the intake stage 14 are prevented from flowing into the introduction path 17 by the shutter 20. Generally, the shutter position is in the closed state.

To be more precise, the shutter 20 is supported slidably (to be opened and closed) in the vertical direction by a support bracket 22 fixed to the underside of the beginning end of the introduction path 17. A slot 21 is made in the underside of the shutter 20. The rotary solenoid 24 is equipped with a rotary board 25. A pin 26 is fixed eccentrically on the rotary board 25 and inserted into the slot 21. Furthermore, the pin 26 is inserted movably into the arched guide slot 23 made in the support bracket 22 in vertical direction. In this embodiment, the rotary solenoid 24 is used as the drive means for driving the shutter 20, however, the drive means is not limited to the rotary solenoid and may be another type solenoid or a motor etc.

The introduction path 17 is composed of four alignment rails 18, 18, 18, 18 mounted parallel to one another, three partition guides 16, 16, 16 disposed between the rails 18 and side plates 15, 15 mounted on both outer sides of the four rails. As shown in FIG. 2, each of the alignment rails 18, 18, is sloped downwardly from its beginning end to its terminal end for the natural flowing of the pachinko balls A. The pachinko balls A, which flow on the alignment rails 18 from the intake stage 14, are formed in line by the alignment rails 18 and are sent to the delivery stage 19.

An upper edge 16*a* of each partition guide 16 is sloped upward from the beginning side to the end side for alignment of the pachinko balls A between the alignment rails 18, 18, . . . . Therefore, the height of the upper edge 16*a* of each partition guide 16 is equal to that of the bottom of the intake stage 14 at the beginning end of the guides 16, however, it becomes higher gradually toward the delivery stage 19.

Figure 3:
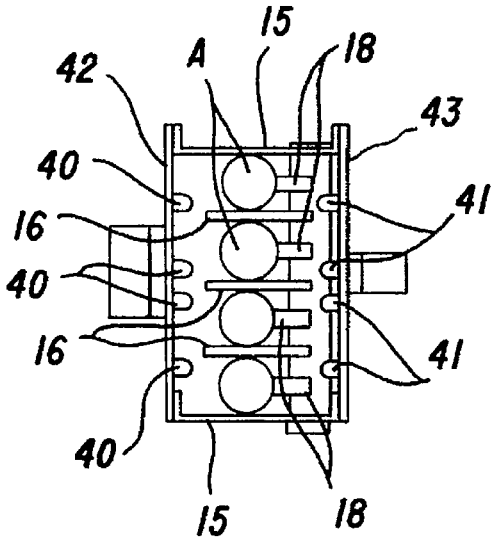
FIG. 3 is a cross sectional view taken along line III—III of FIG. 1.

As shown in FIG. 1~FIG. 3, a sensor board 42 is fixed on the upper of the end side of both side plates 15, 15 and a sensor board 43 is fixed to the underside. The sensor board 42 is equipped with a sensor 40, and the board 43 is equipped with a sensor 41. Sensors 40, 41 are photoelectric switches which consist of radiative means and detective means, and each alignment rail is equipped with the sensors at the end side of the introduction path 17. The output signals from these sensors 40, 41 are processed with a control device (not shown in drawings) and are used for displaying the number of pachinko balls or other objects.

As shown in FIG. 1 and FIG. 2, a respective moving body 30 is mounted above the beginning end of each of the alignment rails 18. Each moving body 30 is formed like a short cylinder. The moving bodies 30 are located individually above each alignment rail 18 and are both eccentrically and rotatably mounted to the horizontal axis 31 placed on both upper portions of the side plates 15, 15. In one side of the moving body 30 opposed to the side where the moving body is mounted to the horizontal axis 31, a weight 32 is fixed so that the center of gravity of the moving body is obviously one-sided. Although in the above embodiment the moving body 30 is mentioned as a necessary part, this embodiment does not always need to be equipped with the moving bodies 30.

The end of the introduction path 17 is joined together with the entrance 19*a* of the delivery stage 19. The direction of the exit 19*b* of the delivery stage 19 is at a right angle to the direction of the entrance 19*a*. As shown in FIG. 2, the delivery stage 19 is fixed to a stage support 62, and the stage support 62 is movably mounted to a support bracket 64 by pivots 63, 63.

The delivery stage 19 is equipped with a ball dropping apparatus 50 at the exit 19*b*. This ball dropping apparatus 50 absorbs the energy of dropping balls delivered from the delivery stage 19; therefore, the trouble that the bottom of the recovery gutter (not-shown) is made to have holes by the impact of the dropping balls is prevented. Furthermore, the bridging phenomenon, which generates when the reduction bellows is used, is not generated.

Figure 5:
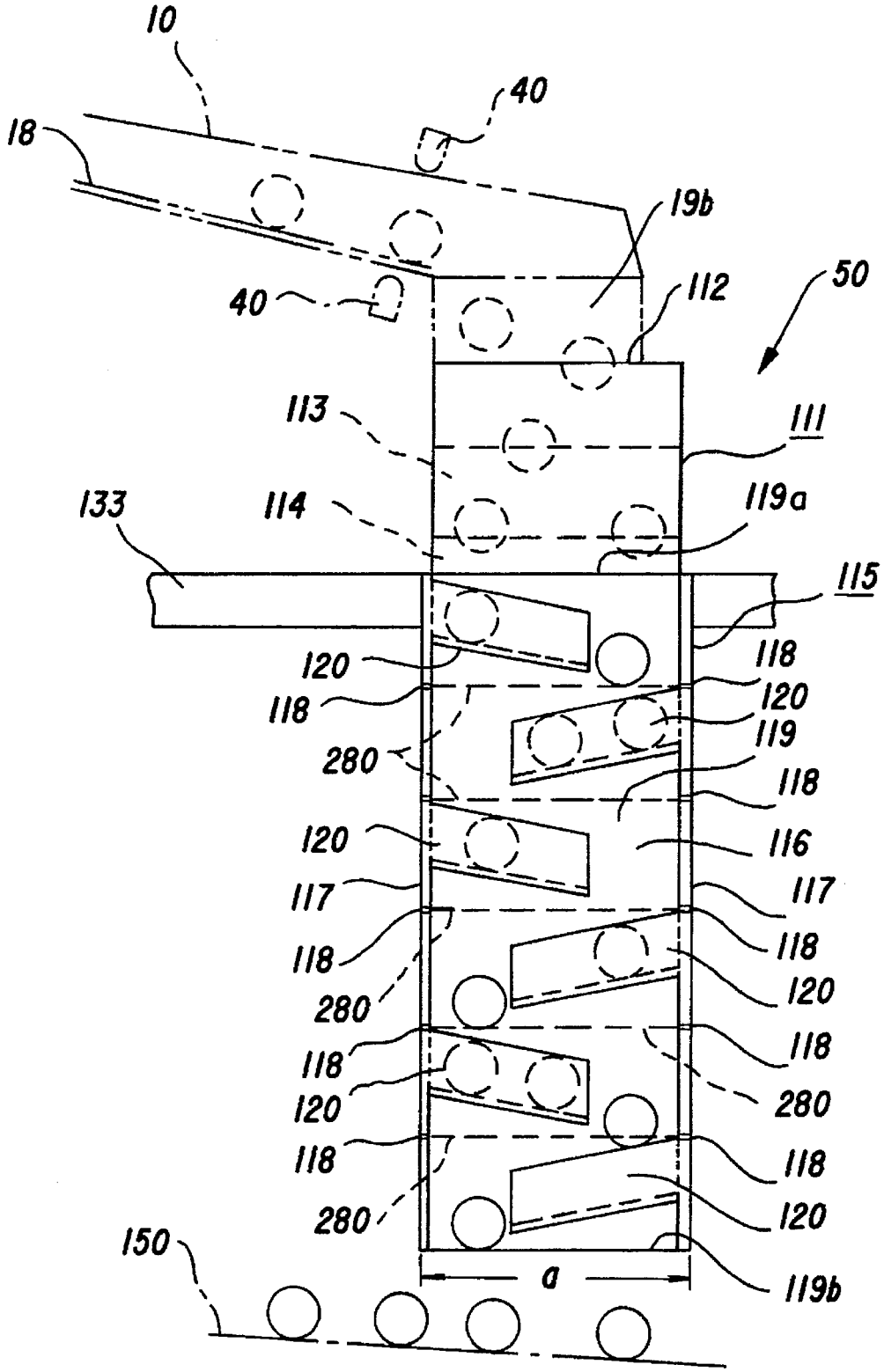
FIG. 5 is a front view showing one embodiment of a pachinko ball dropping apparatus of the invention.
Figure 6:
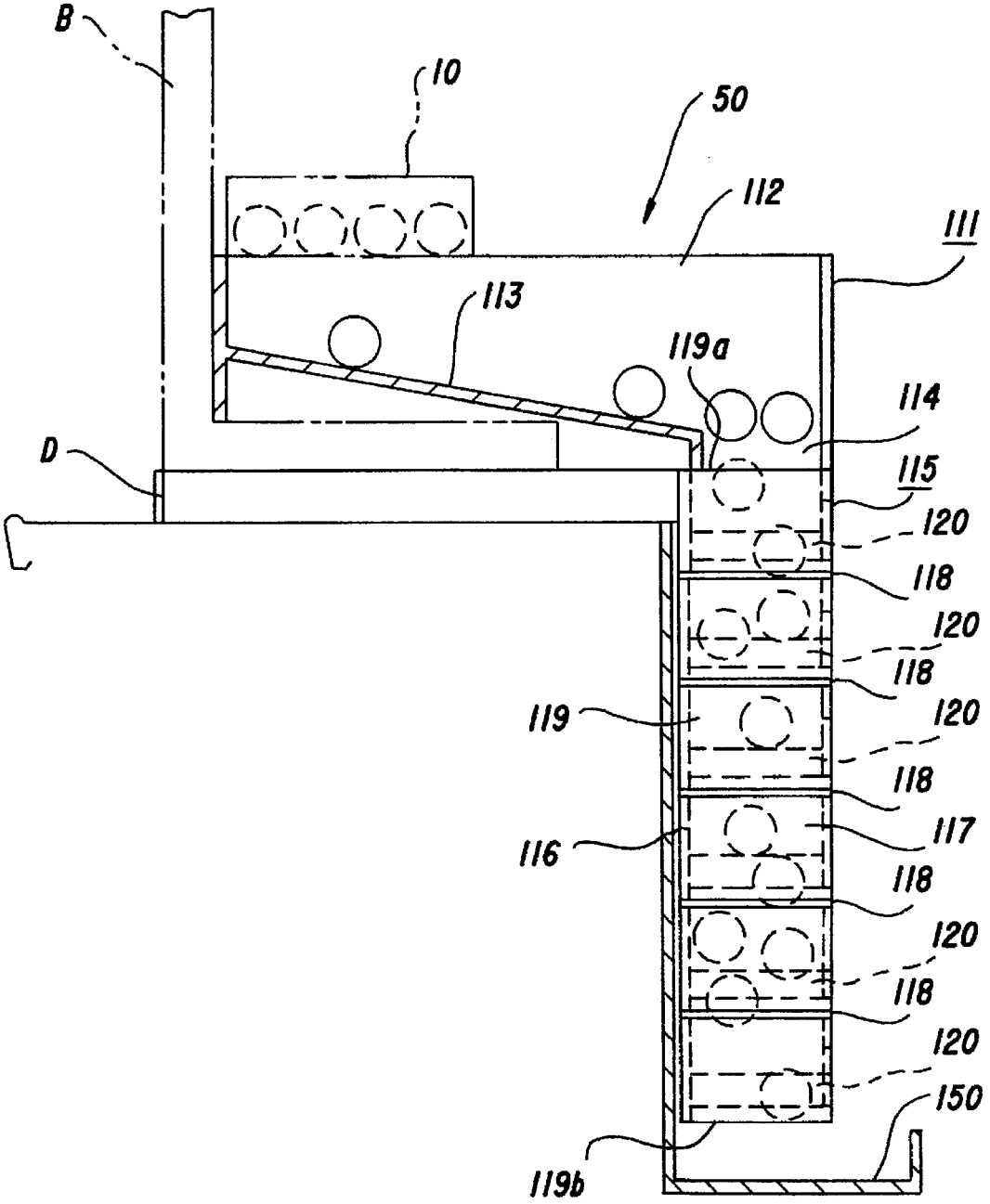
FIG. 6 is a side view showing one embodiment of a pachinko ball dropping apparatus of the invention.

As shown in FIG. 5 and FIG. 6, the ball dropping apparatus 50, mounted in each game machine B of the game island, introduces and drops pachinko balls which are discharged after counting with the ball counter into the recovery gutter 150 located in the lower portion of the game island.

The ball dropping apparatus 50 is opened is front of the exit 19*b* of the pachinko ball counter 10 and has a hopper member 111 for accommodating pachinko balls and a guide member 115 connected to a sending-out opening 114 made in a bottom 113 of the hopper member 111. A large rectangular opening 112 for accommodating pachinko balls is formed at the upper end of the hopper member 111, and the bottom 113 is sloped to allow pachinko balls to flow naturally through the sending-out opening 114.

The guide member 115 introduces pachinko balls, dropped from the sending-out opening 114 of the hopper 111, gently to the recovery gutter 150 located in the lower portion of the game island. The guide member 115 comprises a back frame portion 116 elongated in the vertical direction and both side frame portions 117, 117 elongated forward from both side edges of the back frame portion 116, and the cross section of the guide member 115 is like U-shape. Both of the back frame portion 116 and the side frame portions 117, 117 are formed to be elongated and rectangular.

Figure 7:
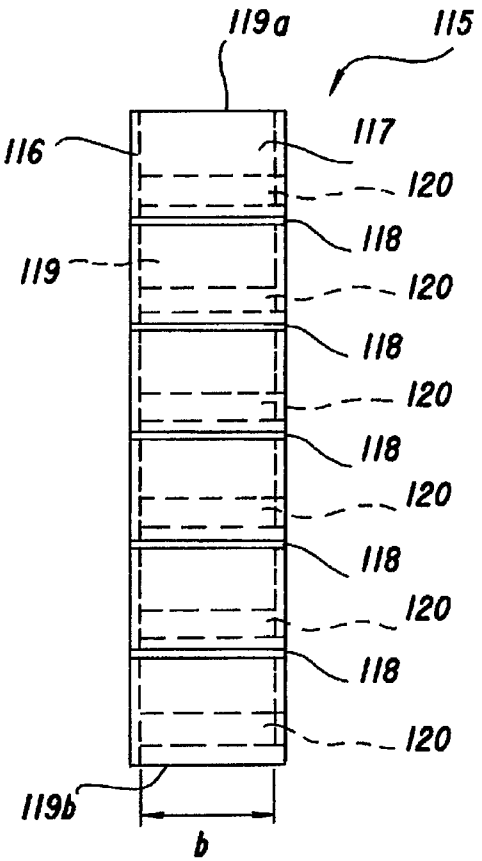
FIG. 7 is a side view showing a guide member which constitutes one embodiment of a pachinko ball a dropping apparatus of the invention.

To describe in detail, as shown in FIG. 7, the widths b of both side frame portions 117, 117 are about a size such that the pachinko balls, discharged from the pachinko ball counter 10 at a high speed and aligned in lines, can pass smoothly.

As shown in FIG. 5~FIG. 7, a space encompassed by both side frame portions 117, 117 and the back frame portion 116 provides a ball path 119 for dropping pachinko balls. An upper end 119*a* of the ball path 119 is connected to the sending-out opening 114 of the hopper 111, and a lower end 119*b* of the elongated guide member extends into the inside of the recovery gutter 150.

Plural damper members 120, as shown in FIG. 5, are mounted alternately on the inside of both side frame portions 117, 117. The damper members 120 absorb the energy of balls dropping inside the ball path 119; therefore, the trouble that the recovery gutter 150 is made to have holes or that terrific crashing sounds are generated by the impacts of the dropping balls is prevented.

To describe in detail, the cross section of each damper member 120 is formed like a U-shape whose upper side is opened. The damper members 120 are alternately fixed to respective side frame portions 117,117 at equal spaces and are sloped downwardly a little. The tip side of each damper member 120 fixed to one side frame portion 117 is positioned between the tip sides of the adjacent damper member 120 fixed to the other side frame portion 117.

Some notches 118, elongated horizontally to the overall widths of both side frame portions 117, 117 of the guide member 115, are cut in both side frame portions 117, 117 at equal spaces in the vertical direction. In this embodiment, each space between each damper member 120 is approximately equal to the space between notches. The damper members 120 are fixed to every other notch on the both side frame portions 117, 117. At the same height, only one of the two notches of the both side frame portions 117, 117 is equipped with a damper member 120.

It is possible to adjust the lower end position of the guide member 115 to the height of the recovery gutter 150 by cutting off the guide member 115 at an arbitrary notch. Both guide members 115 and dumper members 120 are made of materials such as rubber or soft synthetic resin; therefore, the crashing sound generated by the impact of the balls is small, and the guide members 115 can be cut off easily along the notches 118.

As shown in FIG. 6, the ball dropping apparatus 50, together with the pachinko ball counter 10, is mounted in the game machine B. A plurality of game machines B are aligned on a top board of the game island. In this embodiment, as shown in FIG. 8, although the game machine is a slot machine using a pachinko ball as a game medium (generally called "Pachisulo"), it may be any game machine, such as a common pachinko ball machine, as long as a pachinko ball is used as a game medium.

The pachinko ball counter 10 counts a ball which is inserted from a ball inserting port D of the tray C into the inside of the game machine B. As shown in FIG. 1 and FIG. 2, the pachinko ball counter 10 comprises the intake stage 14 for taking in pachinko balls inserted from the ball inserting port D, the introduction path 17 whose beginning end is connected to the intake stage 14, four alignment rails 18, 18 mounted parallel to one another within the introduction path 17, counting sensor 40, disposed at the end side of each alignment rail 18, and the delivery stage 19 connected to the end side of the introduction path 17.

The inlet 14*a* of the intake stage 14 is connected to the ball inserting port D, and the outlet 14*b* of the intake stage 14 is in a perpendicular direction and connected to the beginning end of the introduction path 17. A shutter 20 which is able to be opened and closed is mounted between the outlet 14*b* of the intake stage 14 and the beginning end of the introduction path 17. The shutter 20 is able to be opened and closed by the use of a rotary solenoid 24 as a drive means. When in the closed state, the pachinko balls in the intake stage 14 are prevented from flowing into the introduction path 17 by the shutter 20.

The introduction path 17 has four alignment rails 18, 18, mounted parallel to one another, three partition guides 16, 16, 16 disposed between the rails 18 and side plates 15, 15 mounted on both outer sides of the four rails. The pachinko balls, flowed in the alignment rails 18 from the intake stage 14, are formed in lines by the alignment rails 18 and sent to the delivery stage 19.

The sensor boards 42, 43 are fixed at the end side on the upperside and the underside of both side plates 15, 15. The sensor boards 42, 43 are equipped with a sensor 40, 41. Sensors 40, 41 are photoelectric switches which consist of radiative means and detective means, and each alignment rail 18 is equipped with the sensors at the end side of the introduction path 17.

The end of the introduction path 17 is joined together with the entrance 19*a* of the delivery stage 19. The direction of the exit 19*b* of the delivery stage 19 is at right angle to the direction of the entrance 19*a*.

A summary of the operation of the discussed embodiment is explained next.

When pachinko balls A have been inserted from the ball inserting port D of the tray C of the Pachisulo B, shown in FIG. 8, into the inside of the Pachisulo B, the pachinko balls A are taken into the intake stage 14 of the pachinko ball counter 10, shown in FIG. 1, mounted within the Pachisulo B. If the shutter 20, between the outlet 14*b* of the intake stage 14 and the beginning end of the introduction path 17, is in a closed state (shown in FIG. 4 with phantom lines) at that time, the pachinko balls A cannot flow into the introduction path 17, but are stored temporarily in the intake stage 14.

When the state of the shutter 20 has been changed from the closed state to the opened state (shown in FIG. 4 with full lines) by the player's operation or the instructions from a controller (not shown), the pachinko balls A in the intake stage 14 flow into the beginning side of the introduction path 17.

After flowing into the introduction path 17, the pachinko balls A flow onto four alignment rails 18, 18, 18, 18 mounted parallel to one another and run between the beginning end and the terminal end of the introduction path 17. If the pachinko balls A come in layers from the intake stage 14 and reach to the terminal end of the introduction path 17 by the pushing following balls, the balls on the upper edge 16*a* of each partition guide 16 cannot go forward on the upper edge 16*a* and fall down from there; therefore, the pachinko balls are distributed on the alignment rails 18. Thus, the pachinko balls on each alignment rail 18 are prevented from being layered, and the bridging phenomenon does not occur.

Furthermore, even if the pachinko balls would flow in layers, pachinko balls above the lowest layer hit against the moving bodies 30 and are stopped from forward flowing. At that time, since the upper layer's pachinko balls can still move slightly by the motion of the moving bodies 30, the lowest layer's balls are not prevented from flowing forwardly.

Thus, the pachinko balls A in the introduction path 17 are distributed by the partition guides 16 among the alignment rails 18, and the pachinko balls A flow down to the end side of the introduction path 17 on each of the alignment rails 18, 18 in an aligned state; thereby, a lot of pachinko balls A, in an aligned state, flow to the counters 40, 41 mounted to each of the alignment rails 18, 18 . . . , and so a great number of pachinko balls A can be counted smoothly and quickly. At that time, a controller (not shown) processes detecting signals from counters 40, 41 to display the number of counted pachinko balls or to issue a receipt.

Although, in this embodiment, four alignment rails are located in parallel between the beginning end to the terminal end of the introduction path, the number of alignment rails is not limited to four, and more than four rails may be used as alignment rails.

Thus, in the game machine B. pachinko balls, counted by pachinko ball counter 10, are discharged into the ball dropping apparatus 50 of the hopper 111 through the opening 112. The pachinko balls in the hopper 111 flow along the slanted bottom 113 downwardly and then the balls are sent from the sending-out opening 114 to the guide member 115.

The pachinko balls drop within the ball path 119 encompassed by both side frame portions 117, 117 and one back frame portion 116, and at that time the energy of dropping balls is absorbed by the damper members 120 mounted alternately on the inside of the both side frame portions 117, 117. Therefore, the pachinko balls are introduced smoothly and gently into the recovery gutter 150.

The widths of both of the side frame portions 117, 117 and the back frame portion 116 of the guide member 115 are about a size such that a plurality of pachinko balls can pass concurrently; therefore, lots of pachinko balls discharged from the pachinko ball counter 10 drop smoothly and gently.

As shown in FIG. 5, since there is nothing at the front side of the ball path 119 encompassed by both side frame portions 117, 117 and the back frame portion 116, it is clear that the pachinko balls drop within the ball path 119 while hitting against the damper members 120 to the recovery gutter 150. Furthermore, it is easy to remove and eliminate any jammed balls and dust in the ball path 119.

Since a plurality of notches 118 for arbitrary cutting off of the guide member 115 are made on both side frame portions 117, 117, it is easy to cut off the guide member 115 at an arbitrary notch; thereby, waste odd pieces of the guide member 115 are not made, and it is easy to quickly adjust the position of the lower end 119*b* to the height of the recovery gutter 150.

The guide member 115 that has been made somewhat longer can be easily adjusted to the height of the recovery gutter 150 by cutting it off at the proper notch; further, the remaining portion of the guide member 115 can be utilized for other pachinko ball dropping apparatus, therefore, it is economical.

Although the guide member 115 can be wrested (e.g. broken) by one's hands along the notch 118, it can be cut off more easily by using a knife such as retractable knife.

INDUSTRIAL APPLICABILITY

According to the pachinko ball counter of this invention, pachinko balls discharged into a game machine are aligned in a plurality of lines by a plurality of alignment rails and then reliably sent to counting sensors without generating the so-called "bridging phenomenon." A large number of pachinko balls can be counted smoothly and quickly. Thus, in a game machine which uses lots of pachinko balls as game media, a game can progress smoothly.

Furthermore, according to the pachinko ball dropping apparatus of this invention, the pachinko balls received in a hopper member drop within the ball path encompassed by both side frame portions and the back frame portion of a guide member; at that time, the energy of dropping balls is absorbed by the damper members mounted alternately on the inside of both side frame portions, and the pachinko balls are set to a recovery gutter. Therefore, when the pachinko ball counter discharges a large number of the pachinko balls at a high speed, the pachinko balls are introduced into the recovery gutter while dropping smoothly and gently without the bridging phenomenon.

Furthermore, according to the pachinko ball dropping apparatus of this invention, since a plurality of notches for arbitrary cutting off the guide member are made on are made on both side frame portions, it is easy to cut off the guide member at an arbitrary notch; thereby, waste odd pieces of the guide member are not made, and it is easy to quickly adjust the position of the lower end to the height of the recovery gutter.

We claim:

1. A pachinko ball counter for counting balls discharged into a tray by a player comprising:

an introduction path for receiving pachinko balls;

counting sensors mounted at an end side of said introduction path;

said introduction path including a plurality of alignment rails, through which pachinko balls flow in an aligned state, juxtaposed with one another between a beginning end and a terminal end of the introduction path, and including partition guides disposed between said alignment rails, said counting sensors being disposed at the end side of the introduction path as to correspond to the alignment rails, respectively.

2. A pachinko ball counter as claimed in claim 1, further including an intake stage, connected to a beginning end of said introduction path, for taking in pachinko balls, and a shutter, mounted between said intake stage and said beginning end of said introduction path, being able to be opened and closed.

3. A pachinko ball counter as claimed in claim 1, wherein said plurality of said alignment rails are aligned parallel to one another and are inclined downwardly from the beginning end to the terminal end for natural flowing of the pachinko balls, and wherein an upper edge of each said partition guide which is mounted between the alignment rails is sloped upward from the beginning side to the end side such that the pachinko balls may not get over the partition guide.

4. A pachinko ball counted as claimed in claim 2, wherein said plurality of said alignment rails are aligned parallel to one another and are inclined downwardly from the beginning end to the terminal end for natural flowing of the pachinko balls, and wherein an upper edge of each partition guide which is mounted between the alignment rails is sloped upward from the beginning side to the end side such that the pachinko balls may not get over the partition guide.

5. A pachinko ball counter as claimed in claim 1, 2, 3 or 4, further including a moving body mounted above the beginning end of each alignment rails for pachinko balls above a lowest layer to hit against so as to stop their forward flowing.

6. A pachinko ball counter as claimed in claim 1, 2, 3 or 4 further including a cylindrical ball dropping apparatus mounted at the end side of said introduction path for introducing discharged pachinko balls downward and damper members mounted on an inside of said ball dropping apparatus for absorbing the energy of the dropping balls.

7. A pachinko ball counter as claimed in claim 5, further including a cylindrical ball dropping apparatus mounted at the end side of said introduction path for introducing discharged pachinko bails downward and damper members mounted on an inside of said ball dropping apparatus for absorbing the energy of the dropping balls.

8. A pachinko ball dropping apparatus for a game machine mounted on a game island for introducing and dropping pachinko balls, counted and discharged by a pachinko ball counter, into a recovery gutter located in the lower portion of the game, said pachinko ball dropping apparatus comprising:

a hopper member having an upper opening faceable to an exit for accommodating pachinko balls;

a guide member, connected to a sending-out opening made in a bottom of said hopper member, which includes a back frame portion elongated in the vertical direction and two side frame portions elongated forward from opposite side edges of the back frame portion; and a plurality of damper members mounted alternately on an inside of each of said side frame portions for absorbing the energy of dropping balls dropping within a ball path encompassed by both said side frame portions and said back frame portion, both said side frame portions having a plurality of cut notches in a vertical direction for adjusting the position of the lower end of said guide member to the height of the recovery gutter by enabling cutting off the guide member at an arbitrary one of said notches.

* * * * *